US011652335B2

(12) United States Patent
Nakano et al.

(10) Patent No.: US 11,652,335 B2
(45) Date of Patent: May 16, 2023

(54) SPARK PLUG

(71) Applicant: NGK SPARK PLUG CO., LTD., Nagoya (JP)

(72) Inventors: Seiji Nakano, Nagoya (JP); Kengo Fujimura, Nagoya (JP); Shota Takaenoki, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 14 days.

(21) Appl. No.: 17/619,944

(22) PCT Filed: Dec. 22, 2020

(86) PCT No.: PCT/JP2020/047998
§ 371 (c)(1),
(2) Date: Dec. 16, 2021

(87) PCT Pub. No.: WO2021/215051
PCT Pub. Date: Oct. 28, 2021

(65) Prior Publication Data

US 2022/0360052 A1 Nov. 10, 2022

(30) Foreign Application Priority Data

Apr. 20, 2020 (JP) ..... JP2020-074612

(51) Int. Cl.
*H01T 13/34* (2006.01)
*H01T 13/36* (2006.01)

(52) U.S. Cl.
CPC ..... *H01T 13/34* (2013.01); *H01T 13/36* (2013.01)

(58) Field of Classification Search
CPC ..... H01T 13/34; H01T 13/36
(Continued)

(56) References Cited

U.S. PATENT DOCUMENTS 6,191,525 B1 2/2001 Tanaka et al.
11,581,708 B2 * 2/2023 Resnick ..... H01T 13/39
(Continued)

FOREIGN PATENT DOCUMENTS

CN 109638651 A * 4/2019
JP 1999-067422 A 3/1999
(Continued)

OTHER PUBLICATIONS

International Search Report from corresponding International Patent Application No. PCT/JP20/47998, dated Mar. 16, 2021.

*Primary Examiner* — Christopher M Raabe
(74) *Attorney, Agent, or Firm* — Kusner & Jaffe

(57) ABSTRACT

To prevent a sealant from intruding between a flange and a stepped portion during manufacture of a spark plug and to prevent cracking of an insulator during use of the spark plug, a spark plug includes a center electrode including a flange, an insulator having a through-hole extending in an axial-line direction and holding the center electrode, and a sealant filled in the through-hole to fix the flange and the insulator to each other; the insulator including a stepped portion in which the through-hole reduces a diameter toward a front end side and that supports the flange, and a small-diameter portion that is continuous with a front end side of the stepped portion and in which the diameter of the through-hole is smaller than in the stepped portion; an angle θ1 formed by the stepped portion and a plane perpendicular to the axial line and an angle θ2 formed by the plane perpendicular to the axial line and an opposing surface of the flange opposing the stepped portion satisfies θ1−θ2≥6°, and in a cross section including the axial line, a maximum diameter D1 of the flange and a diameter D2 of the through-hole at a rear end of the small-diameter portion in the axial-line direction satisfy 0.15 mm≤(D1−D2)/2.

4 Claims, 7 Drawing Sheets

(58) Field of Classification Search
USPC ..... 313/118
See application file for complete search history.

(56) References Cited

U.S. PATENT DOCUMENTS

| | | | | |
|---|---|---|---|---|
| 2011/0254429 | A1 | 10/2011 | Kameda et al. | |
| 2013/0285534 | A1 | 10/2013 | Ochiai et al. | |
| 2015/0188294 | A1* | 7/2015 | Nishida | H01B 3/12 174/110 R |
| 2018/0175592 | A1* | 6/2018 | Uegaki | H01T 13/41 |
| 2019/0214791 | A1 | 7/2019 | Kaji et al. | |

FOREIGN PATENT DOCUMENTS

| | | | |
|---|---|---|---|
| JP | WO2012/105255 | A1 | 7/2014 |
| WO | WO2010/073609 | A1 | 7/2010 |
| WO | WO2017/169929 | A1 | 10/2017 |

* cited by examiner

SPARK PLUG

FIELD OF THE INVENTION

The present disclosure relates to a spark plug.

BACKGROUND OF THE INVENTION

A spark plug that includes an insulator having a through-hole extending in an axial-line direction and a center electrode disposed inside the through-hole is known as an example of an ignition spark plug employed for a gasoline engine (for example, Japanese Unexamined Patent Application Publication No. 11-67422, hereinafter "PTL 1"). In the spark plug described in PTL 1, a stepped portion formed in the through-hole of the insulator by reducing the diameter of the through-hole toward the front end supports a flange of a center electrode protruding radially outward. In such a spark plug, a sealant is filled in the through-hole around the flange to fix the center electrode to the insulator.

Technical Problem

The sealant may be filled in the through-hole from the rear end during manufacture of the spark plug, and may intrude into a space between the flange and the stepped portion while being filled. Generally, the coefficient of thermal expansion of the center electrode is larger than the coefficient of thermal expansion of the insulator. Thus, when the spark plug is used under high-temperature environments, the center electrode is more likely to thermally expand more than the insulator. Thus, when a spark plug where the sealant intrudes between the flange and the stepped portion is installed in the internal combustion engine under high-temperature environments, the flange of the center electrode comes into contact with the stepped portion of the insulator via the sealant interposed therebetween attributable to thermal expansion of the center electrode. When the center electrode thermally expands further from this state, a stress may be exerted from the flange to the stepped portion through the sealant, and the insulator may crack. Foreign objects such as soot may intrude between the flange and the stepped portion from a combustion chamber. Also in such a case, a stress may be exerted from the flange of the center electrode to the stepped portion of the insulator through the foreign object, and the insulator may crack. To avoid this, a technology for preventing a sealant from intruding between the flange and the stepped portion during manufacture of a spark plug and preventing the insulator from cracking during use of the spark plug has been desired.

SUMMARY OF THE INVENTION

The present disclosure can be embodied in the following form.

(1) An aspect of the present disclosure provides a spark plug. The spark plug includes a center electrode, an insulator, and a sealant. The center electrode includes a leg extending in an axial-line direction parallel to an axial line, and a flange that is continuous with a rear end side of the leg in the axial-line direction and protrudes radially outward beyond the leg. The insulator has a through-hole extending in the axial-line direction. The insulator holds the center electrode in the through-hole. The sealant is filled in the through-hole to fix the flange and the insulator to each other. The insulator includes a stepped portion in which the through-hole reduces a diameter toward the front end side in the axial-line direction to support the flange, and a small-diameter portion that is continuous with a front end side of the stepped portion and in which the diameter of the through-hole is smaller than in the stepped portion. An angle $\theta 1$ formed by the stepped portion and a plane perpendicular to the axial line and an angle $\theta 2$ formed by the plane and an opposing surface of the flange opposing the stepped portion satisfy $\theta 1-\theta 2 \geq 6°$. In a cross section including the axial line, a maximum diameter D1 of the flange and a diameter D2 of the through-hole at a rear end of the small-diameter portion in the axial-line direction satisfy $0.15\ \text{mm} \leq (D1-D2)/2$. In the spark plug with this aspect, an angle $\theta 1$ formed by the stepped portion and a plane perpendicular to the axial line and an angle $\theta 2$ formed by the plane perpendicular to the axial line and an opposing surface of the flange opposing the stepped portion satisfy $\theta 1-\theta 2 \geq 6°$. Thus, the flange of the center electrode and the stepped portion of the insulator can be brought into point contact with each other. This structure can thus improve adhesion between the flange and the stepped portion. This structure can thus prevent a sealant from intruding between the flange and the stepped portion during manufacture of the spark plug. In addition, in a cross section including the axial line, a maximum diameter D1 of the flange and a diameter D2 of the through-hole at a rear end of the small-diameter portion in the axial-line direction satisfy $0.15\ \text{mm} \leq (D1-D2)/2$. This structure can secure a relatively large gap between the stepped portion and the opposing surface of the flange. This structure can thus prevent the gap from being filled up with a foreign object that intrudes from a combustion chamber into the gap. This structure can thus prevent a stress from being applied from the flange of the center electrode to the stepped portion of the insulator via the sealant or the foreign object attributable to thermal expansion of the center electrode during use of the spark plug. The spark plug according to this aspect can thus prevent a sealant from intruding between the flange and the stepped portion during manufacture of the spark plug and prevent the insulator from cracking during use of the spark plug.

(2) In the spark plug according to the above aspect, the angle $\theta 1$ may satisfy $25° \leq \theta 1 \leq 35°$. In the spark plug according to this aspect, the angle $\theta 1$ satisfies $25° \leq \theta 1 \leq 35°$. This structure can thus prevent a sealant from intruding between the flange and the stepped portion during manufacture of the spark plug.

(3) In the spark plug according to the above aspect, the angle $\theta 1$ and the angle $\theta 2$ may satisfy $\theta 1-\theta 2 \leq 20°$. In the spark plug according to this aspect, the angle $\theta 1$ and the angle $\theta 2$ satisfy $\theta 1-\theta 2 \leq 20°$. This structure can thus prevent an excessive increase of the gap between the stepped portion and the opposing surface of the flange, and thus can reduce an amount of a high-temperature gas that intrudes from the combustion chamber into the gap. This structure can thus prevent deformation of the flange attributable to thermal expansion caused by a temperature rise of the center electrode and the insulator with the high-temperature gas, and thus can prevent reduction of adhesion between the flange and the stepped portion.

The present invention can be embodied in various forms, for example, can be embodied in the form of a method for manufacturing a spark plug, or an engine head to which a spark plug is attached.

DETAILED DESCRIPTION OF INVENTION

A. Embodiment

Figure 1:
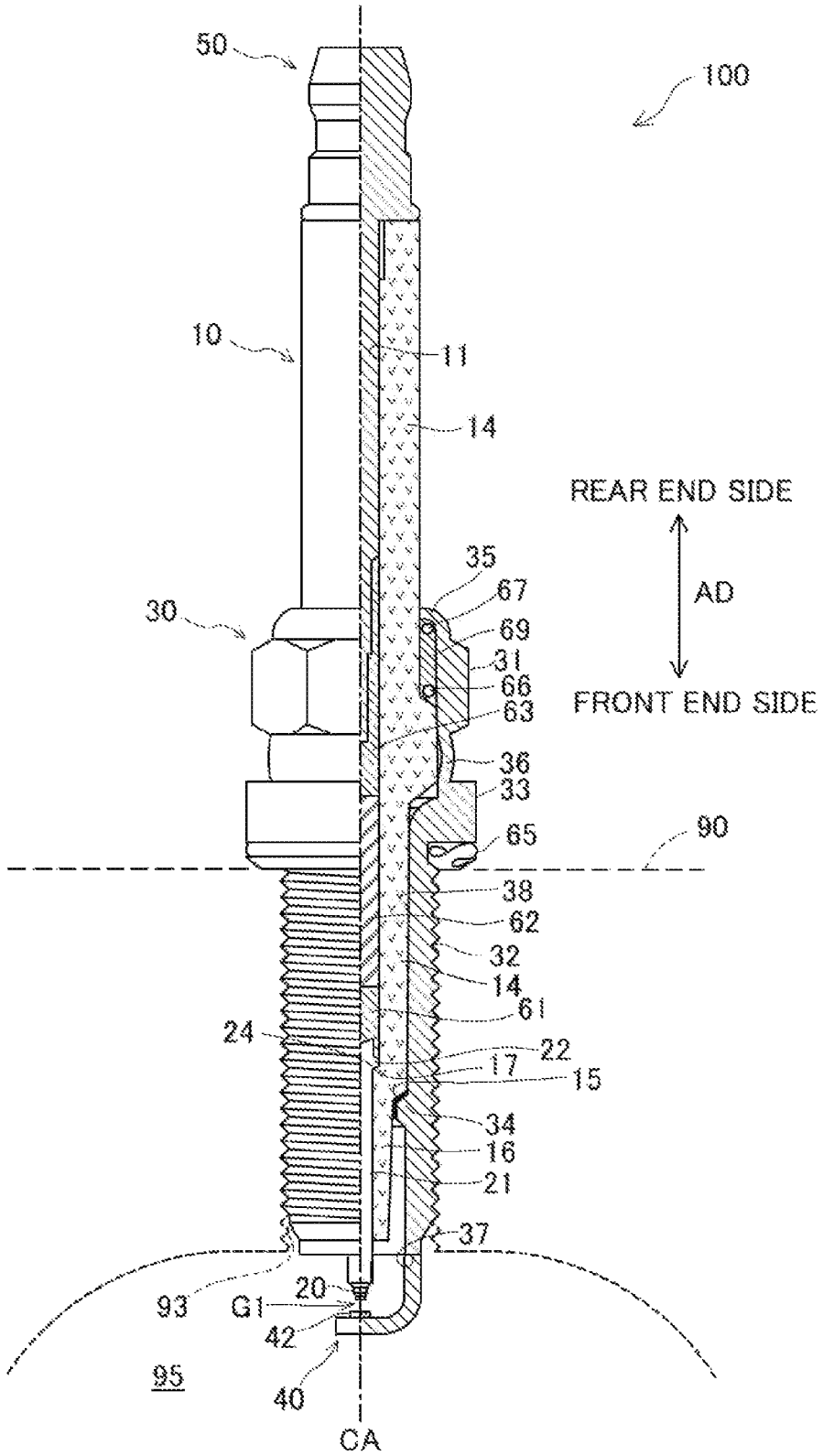
FIG. 1 is a partial cross-sectional view of a schematic structure of a spark plug.

FIG. 1 is a partial cross-sectional view of a schematic structure of a spark plug 100 according to an embodiment of the present disclosure. FIG. 1 illustrates the external appearance of the spark plug 100 on the left side, and a cross section of the spark plug 100 on the right side with respect to an axial line CA serving as an axis of the spark plug 100. In the following description, the lower side in FIG. 1 (side on which a ground electrode 40, described below, is located) in the axial line CA will be referred to as a front end side, the upper side in FIG. 1 (side on which a metal terminal 50, described below, is located) is referred to as a rear end side, and the direction parallel to the axial line CA is referred to as an axial-line direction AD. For illustration purposes, FIG. 1 illustrates, with a broken line, an engine head 90 to which the spark plug 100 is attached.

The spark plug 100 includes an insulator 10, a center electrode 20, a metal shell 30, a ground electrode 40, and a metal terminal 50. The axial line CA of the spark plug 100 is coaxial with the axial lines CA of the insulator 10, the center electrode 20, the metal shell 30, and the metal terminal 50.

The insulator 10 has a substantially cylindrical profile with a through-hole 11 extending in the axial-line direction AD. The through-hole 11 accommodates part of the center electrode 20 on the front end side, and accommodates part of the metal terminal 50 on the rear end side. The insulator 10 thus holds the center electrode 20 inside the through-hole 11. Substantially a half of the insulator 10 on the front end side is accommodated in an axial hole 38 in the metal shell 30, described later, and substantially a half of the insulator 10 on the rear end side is exposed from the axial hole 38. The insulator 10 is a ceramic insulator formed by sintering a ceramic material such as alumina.

The insulator 10 includes a large-diameter portion 14, a locking portion 15, a stepped portion 17, and a small-diameter portion 16. The large-diameter portion 14 is located on the rear end side in the insulator 10 in the axial-line direction AD. The through-hole 11 in the large-diameter portion 14 has a substantially uniform diameter. A portion of the locking portion 15 located closer to the front end side than the large-diameter portion 14 has an outer diameter reducing toward the front end side in the axial-line direction AD.

Figure 2:
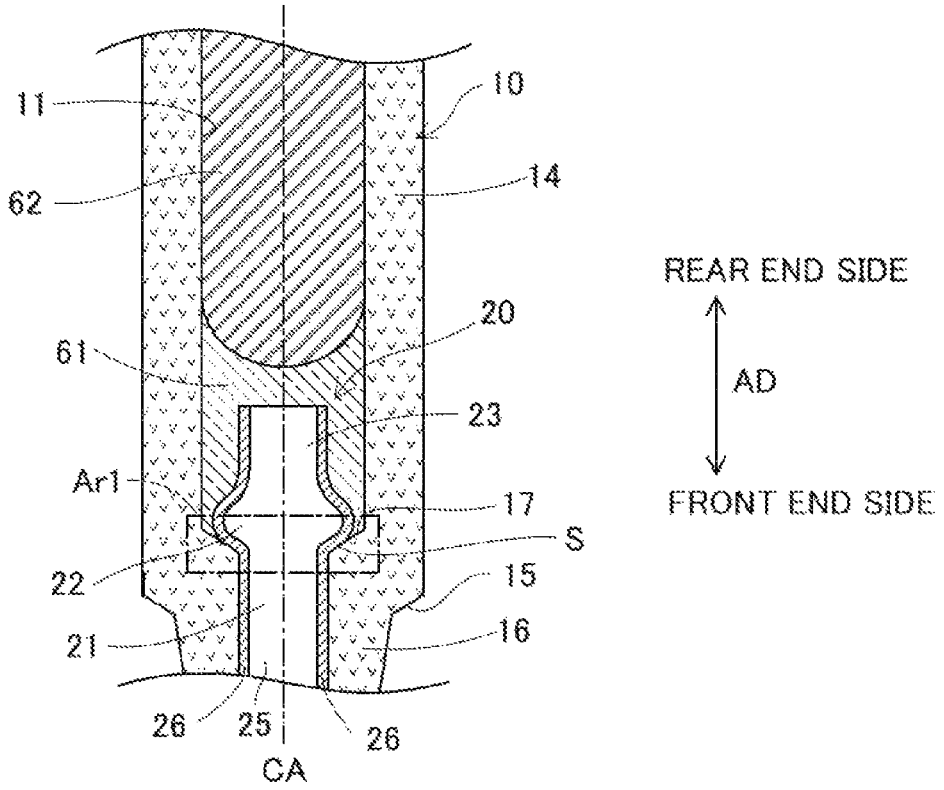
FIG. 2 is an enlarged cross-sectional view of an area around a flange and a stepped portion.

FIG. 2 is an enlarged and schematic cross-sectional view of an area around a flange 22 and the stepped portion 17. FIG. 2 is a cross-sectional view including the axial line CA. The diameter of the through-hole 11 in the stepped portion 17 reduces toward the front end side in the axial-line direction AD. In other words, the stepped portion 17 in the through-hole 11 protrudes radially inward. The stepped portion 17 supports the flange 22 of the center electrode 20. The small-diameter portion 16 illustrated in FIGS. 1 and 2 is continuous with a front end side of the stepped portion 17, and the diameter of the through-hole 11 in the small-diameter portion 16 is smaller than the diameter of the through-hole 11 in the stepped portion 17. The through-hole 11 in the small-diameter portion 16 accommodates part of a leg 21 of the center electrode 20, described later.

The center electrode 20 is a bar-shaped electrode extending in the axial-line direction AD. The center electrode 20 is held in the through-hole 11 in the insulator 10. The center electrode 20 includes the leg 21, the flange 22, and a head 23.

As illustrated in FIG. 1, the leg 21 extends in the axial-line direction AD, and has a portion on the front end side exposed from the through-hole 11. A noble metal tip formed from, for example, an iridium alloy may be joined to the front end of the leg 21.

As illustrated in FIG. 2, the flange 22 is continuous with the rear end side of the leg 21, and protrudes radially outward beyond the leg 21. The flange 22 has an opposing surface S that opposes the stepped portion 17. The opposing surface S is continuous with the leg 21. The flange 22 comes into contact with the stepped portion 17 of the insulator 10 from the rear end side to fix the position of the center electrode 20 in the through-hole 11 in the insulator 10. The head 23 is continuous with the rear end side of the flange 22, and extends in the axial-line direction AD.

The center electrode 20 according to the present embodiment is formed by embedding a highly thermal conductive core material 25 in an electrode member 26. In the present embodiment, the core material 25 is formed from an alloy containing copper as a main component, and the electrode member 26 is formed from a nickel alloy containing nickel as a main component.

As illustrated in FIG. 1, part of the center electrode 20 is received in the front end side of the through-hole 11 in the insulator 10, and part of the metal terminal 50 is received in the rear end side of the through-hole 11 in the insulator 10. Between the center electrode 20 and the metal terminal 50 in the through-hole 11 in the insulator 10, a far-end sealant 61, a resistor element 62, and a rear-end sealant 63 are arranged in order from the front end side toward the rear end side. Thus, the center electrode 20 is electrically connected, on the rear end side, to the metal terminal 50 via the far-end sealant 61, the resistor element 62, and the rear-end sealant 63.

The resistor element 62 is made of ceramic powder, an electrical conducting material, glass, and an adhesive. The resistor element 62 functions as electric resistance between the metal terminal 50 and the center electrode 20, and prevents occurrence of noise when a spark discharge is caused. The far-end sealant 61 and the rear-end sealant 63 are made of electrically conductive glass powder. In the present embodiment, the far-end sealant 61 and the rear-end sealant 63 are made of a powder mixture of copper powder and calcium borosilicate glass powder. The far-end sealant 61 is in contact with the flange 22, the insulator 10, and the resistor element 62 to fix these components to each other. The rear-end sealant 63 is in contact with the resistor element 62, the insulator 10, and the metal terminal 50 to fix these components to each other.

The metal shell 30 has a substantially cylindrical profile having an axial hole 38 extending in the axial-line direction AD, and holds the insulator 10 inside the axial hole 38. More specifically, the metal shell 30 surrounds and holds a portion of the insulator 10 from part of the large-diameter portion 14 to the small-diameter portion 16. The metal shell 30 is made of, for example, low-carbon steel, and entirely plated with, for example, nickel or zinc.

The metal shell 30 includes a tool engagement portion 31, an external-thread portion 32, a seating portion 33, a protrusion 34, a crimping portion 35, and a compressed-deformed portion 36.

To attach the spark plug 100 to the engine head 90, the tool engagement portion 31 is engaged with a tool, not illustrated. The external-thread portion 32 has a thread ridge on the outer peripheral surface of the metal shell 30 at the front end portion, and is screwed on an internal thread 93 of the engine head 90. The seating portion 33 is continuous with the rear end side of the external-thread portion 32 to be in a flange form. An annular gasket 65 formed by folding a plate is inserted into a space between the seating portion 33 and the engine head 90. The protrusion 34 protrudes radially inward from the inner peripheral surface of the external-thread portion 32. The locking portion 15 of the insulator 10 is in contact with the protrusion 34 on the rear end side. The protrusion 34 supports the insulator 10 inserted into the axial hole 38. Annular plate packing, not illustrated, is disposed between the protrusion 34 and the locking portion 15.

The crimping portion 35 on the rear end side of the tool engagement portion 31 has a small thickness. The compressed-deformed portion 36 between the tool engagement portion 31 and the seating portion 33 has a small thickness. From the tool engagement portion 31 to the crimping portion 35 in the axial-line direction AD, annular ring members 66 and 67 are interposed between the axial hole 38 in the metal shell 30 and the outer peripheral surface of the large-diameter portion 14 of the insulator 10. Powder talc 69 is filled between the ring members 66 and 67. As will be described later, the metal shell 30 is crimped at the crimping portion 35 to be assembled to the insulator 10.

The ground electrode 40 is formed from a bent metal bar. As in the case of the center electrode 20, the ground electrode 40 is made of a nickel alloy containing nickel as a main component. The ground electrode 40 has a first end fixed to a front end surface 37 of the metal shell 30, and a second end bent to oppose the front end portion of the center electrode 20. An electrode tip 42 is disposed at a portion of the ground electrode 40 opposing the front end portion of the center electrode 20. Between the electrode tip 42 and the front end portion of the center electrode 20, a gap G1 for spark discharges is formed. The gap G1 is also referred to as a discharge gap or a spark gap.

The metal terminal 50 is disposed at the rear end of the spark plug 100. The front end side of the metal terminal 50 is accommodated in the through-hole 11 in the insulator 10, and the rear end side of the metal terminal 50 is exposed from the through-hole 11. A high-voltage cable, not illustrated, is connected to the metal terminal 50, and a high voltage is applied to the metal terminal 50. This application causes a spark discharge in the gap G1. The spark discharge caused in the gap G1 ignites an air-fuel mixture in a combustion chamber 95.

In the present embodiment, the far-end sealant 61 corresponds to a sealant according to the present disclosure. The front end side corresponds to the front end side in the axial-line direction according to the present disclosure. The rear end side corresponds to the rear end side in the axial-line direction according to the present disclosure.

A method for manufacturing the spark plug 100 will be described, below.

First, the center electrode 20 is inserted into the through-hole 11 in the insulator 10 from the rear end side. Thereafter, a powder material for the far-end sealant 61 is filled into the through-hole 11 from the rear end side and compressed (hereinafter also referred to as a "sealant filling step"). Thereafter, a material for the resistor element 62 is filled into the through-hole 11 from the rear end side and compressed, and then, a powder material for the rear-end sealant 63 is filled into the through-hole 11 from the rear end side and compressed. Each compression may be performed by inserting, for example, a bar-shaped tool into the through-hole 11 to press the material. Thereafter, the front end of the metal terminal 50 is inserted into the through-hole 11, to compress the materials with a predetermined pressure exerted from the side closer to the metal terminal 50 while the entirety of the insulator 10 is heated (hereinafter also referred to as a "heat compression step"). In the heat compression step, the materials filled in the through-hole 11 are compressed and sintered. Thus, the far-end sealant 61, the resistor element 62, and the rear-end sealant 63 are formed in the through-hole 11. The center electrode 20 is fixed to the insulator 10 in this manner.

Thereafter, the insulator 10 to which the center electrode 20 is fixed is inserted into the axial hole 38 in the metal shell 30 from the rear end side. The crimping portion 35 of the metal shell 30 is then crimped to fix the metal shell 30 and the insulator 10 to each other. Here, the crimping portion 35 of the metal shell 30 has its front end side pressed while being folded radially inward, so that the compressed-deformed portion 36 is compressed and deformed. The compression and deformation of the compressed-deformed portion 36 presses the insulator 10 toward the front end side inside the metal shell 30 via the ring members 66 and 67 and the talc 69. Thus, the spark plug 100 is complete.

Figure 3:
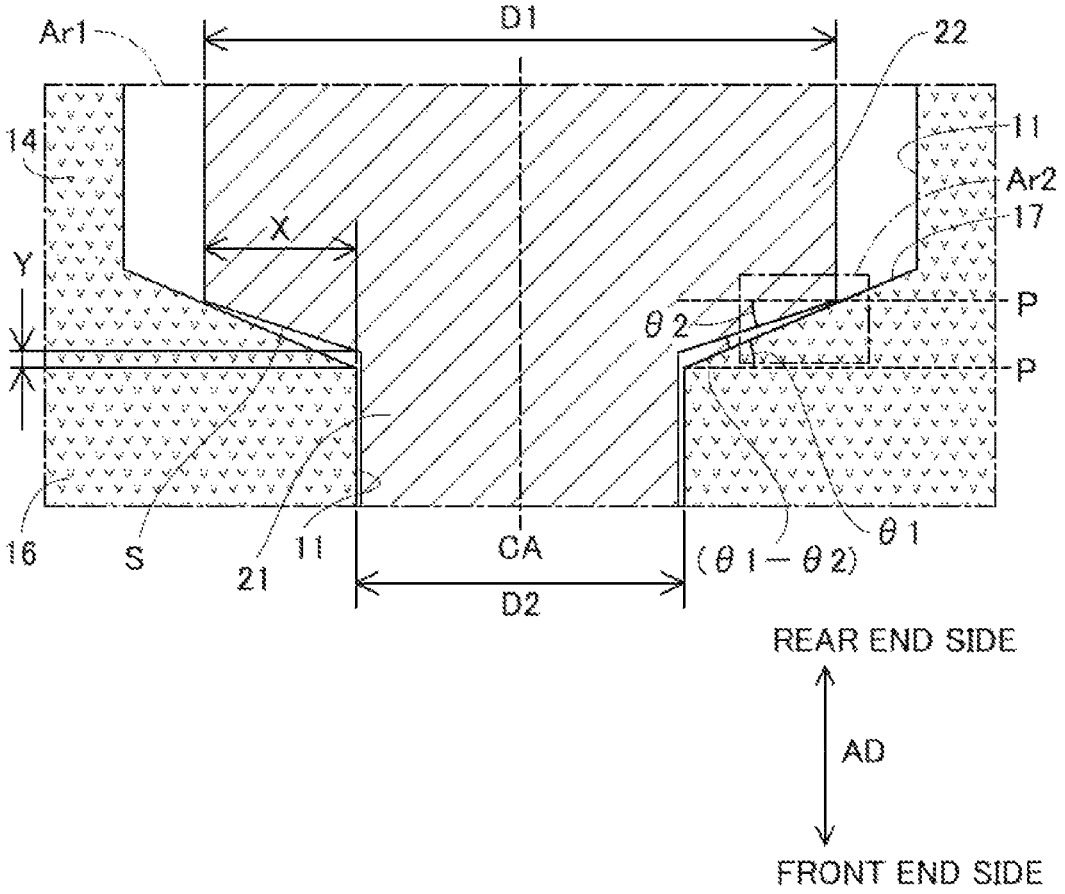
FIG. 3 is an enlarged view schematically illustrating an area Ar1 in FIG. 2.
Figure 4:
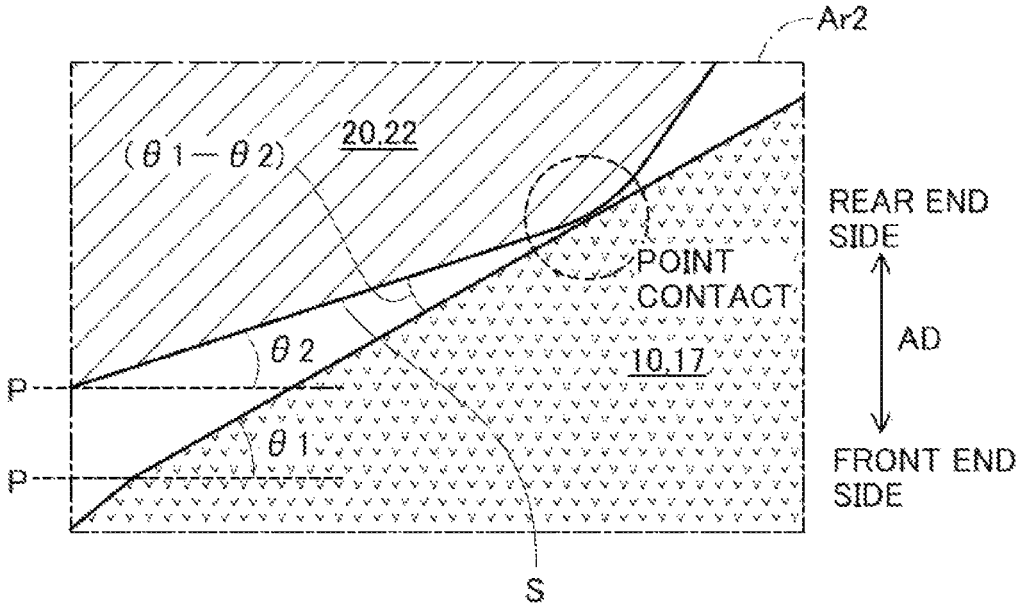
FIG. 4 is an enlarged view schematically illustrating an area Ar2 in FIG. 3.

FIG. 3 is an enlarged view schematically illustrating an area Ar1 in FIG. 2. FIG. 4 is an enlarged view schematically illustrating an area Ar2 in FIG. 3. The spark plug 100 according to the present embodiment satisfies Formula (1), where an angle formed by the stepped portion 17 and a plane P perpendicular to the axial line CA is denoted with θ1, and an angle formed by the plane P and the opposing surface S of the flange 22 opposing the stepped portion 17 is denoted with θ2:

$$\theta 1-\theta 2 \geq 6^\circ \qquad \text{Formula (1).}$$

As illustrated in Formula (1) and FIGS. 3 and 4, the angle θ1 is greater than the angle θ2, and the angle difference (θ1−θ2) between the angles θ1 and θ2 corresponds to the angle formed by the opposing surface S and the stepped portion 17 in a cross section taken along the axial line CA. In this structure, the flange 22 of the center electrode 20 and the stepped portion 17 of the insulator 10 are in point contact with each other. Thus, compared to a spark plug where the flange 22 of the center electrode 20 and the stepped portion 17 of the insulator 10 are in surface contact with each other, adhesion between the flange 22 and the stepped portion 17 can be improved. Thus, in the sealant filling step during manufacture of the spark plug 100, the powder material for the far-end sealant 61 can be prevented from intruding between the flange 22 and the stepped portion 17. In the heat compression step during manufacture of the spark plug 100, the far-end sealant 61 is prevented from intruding between the flange 22 and the stepped portion 17. Thus, the spark plug 100 according to the present embodiment satisfying Formula (1) can prevent the far-end sealant 61 from intruding between the flange 22 and the stepped portion 17 during manufacture of the spark plug 100.

In the present embodiment, the angle θ1 is not limited to a particular one, but preferably greater than or equal to 25° and smaller than or equal to 35°. The angle θ1 greater than or equal to 25° and smaller than or equal to 35° can further improve adhesion between the flange 22 and the stepped portion 17. This structure can thus further prevent the far-end sealant 61 from intruding between the flange 22 and the stepped portion 17 during manufacture of the spark plug 100.

The upper limit of the angle difference (θ1−θ2) is not limited to a particular value, but the angle difference (θ1−θ2) is preferably smaller than or equal to 20°. The angle difference (θ1−θ2) smaller than or equal to 20° can prevent an excessive increase of a gap between the opposing surface S of the flange 22 and the stepped portion 17, and thus can reduce an amount of the high-temperature gas intruding into the gap from the combustion chamber 95. This structure can prevent an excessive increase of the quantity of heat provided to the center electrode 20 and the insulator 10, and thus can prevent an excessive increase of thermal expansion of the center electrode 20 and the insulator 10. This structure can thus prevent deformation of the flange 22 attributable to thermal expansion caused by a temperature rise of the center electrode 20 and the insulator 10 with a high-temperature gas, and thus can prevent reduction of adhesion between the flange 22 and the stepped portion 17.

The angle difference (θ1−θ2) smaller than or equal to 20° can also prevent a portion of the flange 22 of the center electrode 20 that is in point contact with the stepped portion 17 of the insulator 10 from having a shape with a nearly acute angle. This structure can thus further prevent reduction of adhesion between the flange 22 and the stepped portion 17. This structure can thus further prevent the far-end sealant 61 from intruding between the flange 22 and the stepped portion 17 during manufacture of the spark plug 100. More specifically, for example, this structure can prevent the powder material of the far-end sealant 61 from intruding between the flange 22 and the stepped portion 17 due to vibrations or other causes caused during, for example, a transportation step between the sealant filling step and the heat compression step.

As illustrated in FIG. 3, the spark plug 100 according to the present embodiment satisfies Formula (2) where, in a cross section including the axial line CA, the maximum diameter of the flange 22 is denoted with D1, and the diameter of the through-hole 11 in the small-diameter portion 16 at the rear end is denoted with D2:

$$0.15\ \text{mm} \leq (D1-D2)/2 \qquad \text{Formula (2).}$$

In Formula (2), when a half of a difference (D1−D2) between the maximum diameter D1 of the flange 22 and the diameter D2 of the through-hole 11 in the small-diameter portion 16 at the rear end is denoted with a dimension X, as illustrated in FIG. 3, the dimension X corresponds to the difference between the radius of the flange 22 at a portion radially protruding to the outermost, and the radius of the through-hole 11 in the small-diameter portion 16 at the rear end. Here, a dimension Y in the axial-line direction AD between the flange 22 and the front end of the stepped portion 17 increases radially inward. Thus, in the spark plug 100 according to the present embodiment, the dimension X greater than or equal to 0.15 mm allows the dimension Y in the axial-line direction AD between the flange 22 and the front end of the stepped portion 17 to be relatively large. To allow the dimension Y to be relatively large, the dimension X is preferably greater than or equal to 0.17 mm, or more preferably, greater than or equal to 0.3 mm. In view of preventing an increase of a radial dimension of the spark plug 100, the dimension X is preferably smaller than or equal to 0.6 mm, and more preferably smaller than or equal to 0.4 mm.

Figure 5:
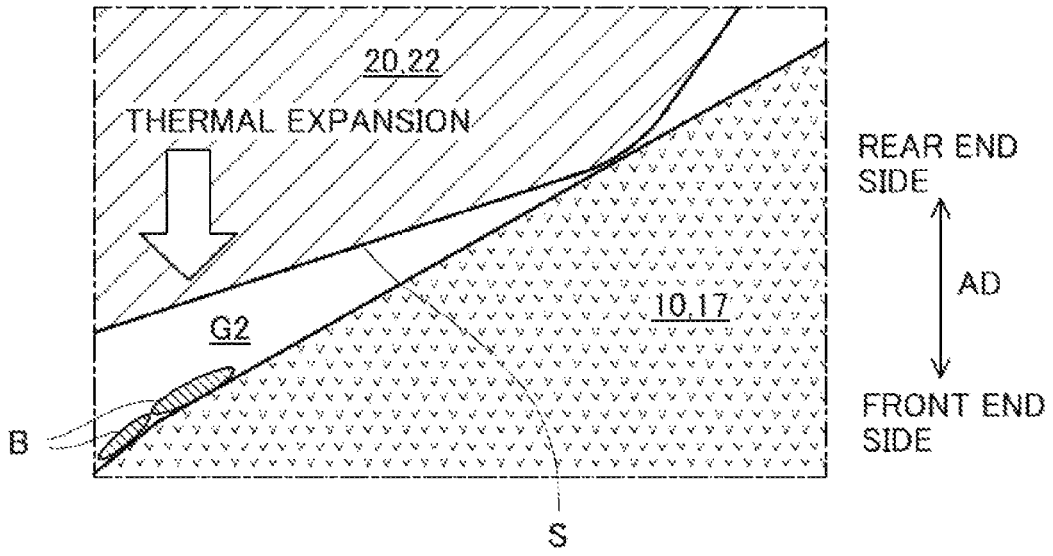
FIG. 5 is a diagram illustrating thermal expansion of a center electrode.

FIG. 5 is a diagram illustrating thermal expansion of the center electrode 20. FIG. 5 is a cross-sectional view corresponding to FIG. 4.

Generally, a coefficient of thermal expansion of the center electrode 20 of the spark plug 100 is greater than the coefficient of thermal expansion of the insulator 10. Also in the spark plug 100 according to the present embodiment, as described above, the center electrode 20 is made of a copper alloy and a nickel alloy, and the insulator 10 is made of ceramics. The coefficient of thermal expansion of the center electrode 20 is thus greater than the coefficient of thermal expansion of the insulator 10. Thus, when the spark plug 100 is used under high-temperature environments, the center electrode 20 is more likely to thermally expand further than the insulator 10 toward the front end side in the axial-line direction AD as indicated with a solid-white arrow in FIG. 5.

The spark plug 100 according to the present embodiment satisfies Formula (1) and Formula (2), and thus forms a relatively large gap G2 between the stepped portion 17 and the opposing surface S of the flange 22. This structure can thus prevent an application of stress to the stepped portion 17 of the insulator 10 from the flange 22 of the center electrode 20 attributable to thermal expansion of the center electrode 20 during use of the spark plug 100. This structure can thus prevent the insulator 10 from cracking during use of the spark plug 100.

As illustrated in FIG. 1, the spark plug 100 is generally attached to the engine head 90, and used while having the front end portion exposed to the inside of the combustion chamber 95. In the combustion chamber 95, soot or other matter attributable to carbon in a combustion gas is present. Such soot or other matter may intrude into the through-hole 11 in the insulator 10 from the front end side, arrive at the gap G2 between the stepped portion 17 and the opposing surface S of the flange 22 through the space between the through-hole 11 and the leg 21 of the center electrode 20, and accumulate as a foreign object B, as illustrated in FIG. 5.

Unlike in the spark plug 100 according to the present embodiment, in a structure having a small gap between the stepped portion and the opposing surface of the flange that fails to satisfy at least one of Formula (1) and Formula (2), the gap is filled up with the foreign object B, and a stress is applied from the flange of the center electrode to the stepped portion of the insulator via the foreign object B attributable to thermal expansion of the center electrode during use of the spark plug. Thus, the insulator is cracked during the use of the spark plug.

On the other hand, the spark plug 100 according to the present embodiment satisfying Formula (1) and Formula (2) has a relatively large gap G2 between the stepped portion 17 and the opposing surface S of the flange 22. Thus, the gap G2 is prevented from being filled up with the foreign object B regardless of when the foreign object B accumulates in the gap G2. This structure can thus prevent a stress from being applied from the flange 22 of the center electrode 20 to the stepped portion 17 of the insulator 10 attributable to thermal expansion of the center electrode 20 during use of the spark plug 100, and thus can prevent the insulator 10 from cracking during use of the spark plug 100.

The spark plug 100 according to the present embodiment satisfies Formula (1), and thus allows the flange 22 of the center electrode 20 and the stepped portion 17 of the insulator 10 to be in point contact with each other. This structure can thus improve adhesion between the flange 22 and the stepped portion 17, and can prevent the powder material of the far-end sealant 61 from intruding between the flange 22 and the stepped portion 17 in the sealant filling step during manufacture of the spark plug 100. This structure can also prevent the far-end sealant 61 from intruding between the flange 22 and the stepped portion 17 in the heat compression step during manufacture of the spark plug 100. Thus, the spark plug 100 according to the present embodiment satisfying Formula (1) can prevent the far-end sealant 61 from intruding between the flange 22 and the stepped portion 17 during manufacture of the spark plug 100. This structure can prevent the flange 22 of the center electrode 20 and the stepped portion 17 of the insulator 10 from coming into contact with each other via the far-end sealant 61 interposed in between attributable to thermal expansion of the center electrode 20 during use of the spark plug 100. This structure can thus prevent stress from being applied from the flange 22 of the center electrode 20 to the stepped portion 17 of the insulator 10 via the far-end sealant 61 interposed therebetween due to further progress in thermal expansion of the center electrode 20. Thus, the insulator 10 can be prevented from being cracked during use of the spark plug 100.

The spark plug 100 according to the present embodiment satisfies Formula (1) and Formula (2), and thus has a relatively large gap G2 between the stepped portion 17 and the opposing surface S of the flange 22. This structure can thus prevent a stress from being applied from the flange 22 of the center electrode 20 to the stepped portion 17 of the insulator 10 attributable to thermal expansion of the center electrode 20 during use of the spark plug 100. This structure including the relatively large gap G2 can prevent the gap G2 from being filled up with the foreign object B regardless of when the foreign object B intrudes into the gap G2 from the combustion chamber 95 and accumulates in the gap G2. This structure can thus prevent a stress from being applied from the flange 22 of the center electrode 20 to the stepped portion 17 of the insulator 10 via the foreign object B attributable to thermal expansion of the center electrode 20 during use of the spark plug 100. Thus, the insulator 10 can be prevented from being cracked during use of the spark plug 100.

The spark plug 100 according to the present embodiment satisfies Formula (1) and Formula (2). This structure can prevent the far-end sealant 61 from intruding between the flange 22 and the stepped portion 17 during manufacture of the spark plug 100, and prevent the insulator 10 from cracking during use of the spark plug 100.

In addition, the angle θ1 is greater than or equal to 25° and smaller than or equal to 35°. This structure can further improve adhesion between the flange 22 and the stepped portion 17, and thus can further prevent the far-end sealant 61 from intruding between the flange 22 and the stepped portion 17 during manufacture of the spark plug 100.

The angle difference (θ1−θ2) is smaller than or equal to 20°. This structure can prevent an excessive increase of a gap G2 between the opposing surface S of the flange 22 and the stepped portion 17, and thus can reduce an amount of the high-temperature gas intruding into the gap G2 from the combustion chamber 95. This structure can thus prevent deformation of the flange 22 attributable to thermal expansion caused by a temperature rise of the center electrode 20 and the insulator 10 with the high-temperature gas, and thus can prevent reduction of adhesion between the flange 22 and the stepped portion 17.

The angle difference (θ1−θ2) smaller than or equal to 20° can prevent a portion of the flange 22 of the center electrode 20 that is in point contact with the stepped portion 17 of the insulator 10 from having a shape with a nearly acute angle. This structure can thus further prevent reduction of adhesion between the flange 22 and the stepped portion 17. This structure can thus prevent the powder material of the far-end sealant 61 from intruding between the flange 22 and the stepped portion 17 in, for example, a transportation step during manufacture of the spark plug 100. This structure can thus further prevent the far-end sealant 61 from intruding between the flange 22 and the stepped portion 17 during manufacture of the spark plug 100. This structure can prevent a portion of the flange 22 of the center electrode 20 that is in point contact with the stepped portion 17 of the insulator 10 from having a shape with a nearly acute angle. This structure can thus prevent abrasion of the stepped portion 17 at a portion where the flange 22 and the stepped portion 17 are in point contact with each other when the center electrode 20 thermally expands.

B. Example

The present invention will be further specifically described below using examples, but not limited to the following examples.

The spark plugs 100 with different angle differences (θ1−θ2) between the angles °1 and θ2 were evaluated for the occurrence of intrusion of the far-end sealant 61 and cracking of the insulator 10.

<Samples>

The spark plugs 100 satisfying Formula (1) and Formula (2) were fabricated as Examples 1 to 5. Table 1 below shows the angle differences (θ1−θ2) in the spark plugs 100 of Examples 1 to 5. Spark plugs that satisfy Formula (2) without satisfying Formula (1) were fabricated as Comparative Examples 1 and 2. Table 1 below shows the angle differences (θ1−θ2) in the spark plugs of the Comparative Examples 1 and 2. Throughout the spark plugs of Examples 1 to 5 and the Comparative Examples 1 and 2, a half of the value (D1−D2) was 0.17 mm.

Figure 6:
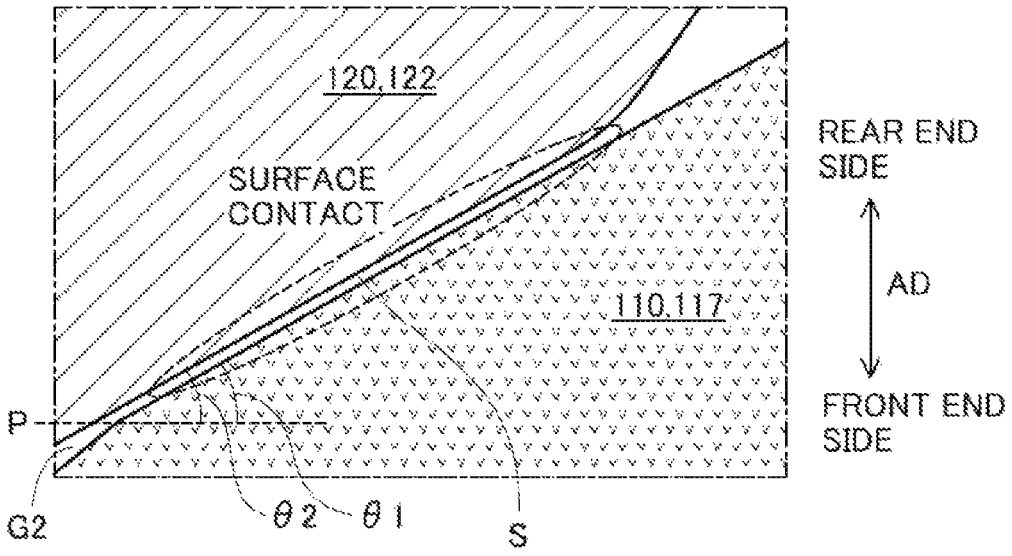
FIG. 6 is a schematic diagram illustrating part of a spark plug according to Comparative Example 1.

FIG. 6 is a schematic diagram illustrating part of a spark plug according to Comparative Example 1. FIG. 6 is a cross-sectional view corresponding to FIG. 4. In the spark plug according to Comparative Example 1, an angle θ1 formed by a stepped portion 117 and the plane P perpendicular to the axial line CA is equal to an angle θ2 formed by the plane P and the opposing surface S of a flange 122 opposing the stepped portion 117. Specifically, the spark plug according to Comparative Example 1 with the angle difference (θ1−θ2) of 0° fails to satisfy Formula (1). In the spark plug according to Comparative Example 1, the flange 122 of a center electrode 120 and the stepped portion 117 of an insulator 110 are in surface contact with each other. Thus, the spark plug according to Comparative Example 1 has a small gap G2 between the stepped portion 117 and the opposing surface S of the flange 122.

The spark plugs 100 satisfying Formula (1) and Formula (2) were fabricated as Examples 6 and 7. Table 2 shows halves of the value (D1−D2) in the spark plugs 100 of Examples 6 and 7. Spark plugs that satisfy Formula (1) without satisfying Formula (2) were fabricated as Comparative Examples 3 and 4. Table 2 shows halves of the value (D1−D2) in the spark plugs of Comparative Examples 3 and 4. Throughout the spark plugs of Examples 6 and 7 and Comparative Examples 1 and 2, the angle difference (θ1−θ2) was 6°.

<Evaluation of Cracking of Insulator>

The samples of Examples 1 to 7 and Comparative Examples 1 and 2 were immersed in exhaust condensate and heated to be exposed to the high-temperature exhaust condensate. The exhaust condensate refers to moisture contained in the exhaust gas cooled at a muffler to condensate and drip. With the above processing, the foreign object B was caused to accumulate in the gap G2 between the stepped portion 17 or 117 and the opposing surface S of the flange 22 or 122. Thereafter, each sample was assembled to the metal fitting, and placed in a high-temperature furnace of approximately 400° C. simulating the inside of an engine. Thereafter, occurrence of cracking of the insulator 10 was evaluated using a scanning electron microscope. The evaluation standards are as follows, and the number of pieces for each sample was between 5 to 10:

A: Not Cracked

C: Cracked.

<Evaluation of Intrusion of Sealant>

The samples of Examples 1 to 5 and Comparative Examples 1 and 2 were evaluated for occurrence of intrusion of the far-end sealant 61 into the gap G2 using a scanning electron microscope. The evaluation standards are as follows, and the number of pieces for each sample was between 5 to 10:

A: Not Intruded

B: Partially Intruded

C: Entirely Intruded

TABLE 1

| | θ1-θ2 (°) | Intrusion of Sealant | Cracking of Insulator |
|---|---|---|---|
| Comparative Example 1 | 0 | C | C |
| Comparative Example 2 | 2 | A | C |
| Example 1 | 6 | A | A |
| Example 2 | 10 | A | A |
| Example 3 | 20 | A | A |
| Example 4 | 22 | B | A |
| Example 5 | 25 | B | A |

The results in Table 1 reveal the followings. In Examples 1 to 5, no cracking was observed in the insulator 10. In Comparative Examples 1 and 2, on the other hand, cracking was observed in the insulator 110.

Figure 7:
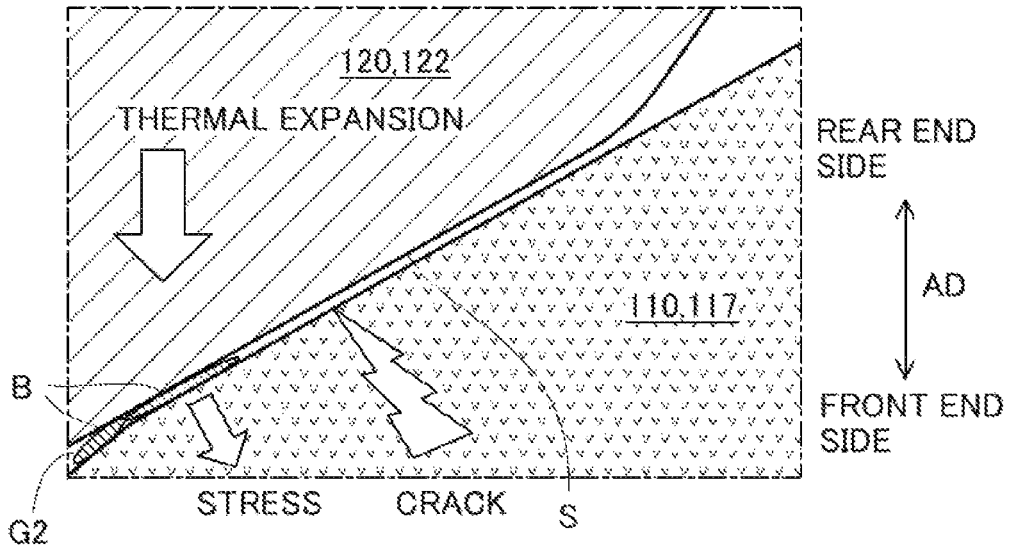
FIG. 7 is a schematic diagram illustrating thermal expansion of a center electrode of the spark plug according to Comparative Example 1.

FIG. 7 is a schematic diagram illustrating thermal expansion of the center electrode 120 of the spark plug according to Comparative Example 1. FIG. 7 is a cross-sectional view corresponding to FIG. 6.

In the spark plug according to Comparative Example 1, the foreign object B is filled in the gap G2. Thus, it is assumed that, in the spark plug according to Comparative Example 1, under high-temperature environments, the center electrode 120 thermally expands as indicated with a solid-white arrow in FIG. 7, and a stress is applied from the flange 122 of the center electrode 120 to the stepped portion 117 of the insulator 110. As a result, the insulator 110 is assumed to have cracked.

The results of Table 1 reveal the followings. Specifically, in Examples 1 to 3 and Comparative Example 2 where the angle difference (θ1−θ2) falls within the range of 2° to 20°, no intrusion of the far-end sealant 61 was observed. In Examples 4 and 5 where the angle difference (θ1−θ2) falls within the range of 22° to 25°, intrusion of the far-end sealant 61 was observed, but by only a small amount. On the other hand, in Comparative Example 1 where the angle difference (θ1−θ2) was 0°, intrusion of the far-end sealant 61 was observed by a large amount.

In Comparative Example 1, the flange 122 and the stepped portion 117 were in surface contact with each other. Thus, adhesion between the flange 122 and the stepped portion 117 in Comparative Example 1 is assumed to be smaller than that in Examples 1 to 5. The powder material of the far-end sealant 61 is thus assumed to have intruded between the flange 122 and the stepped portion 117 in the sealant filling step during manufacture of a spark plug. The far-end sealant 61 is also assumed to intrude between the flange 122 and the stepped portion 117 in the heat compression step during manufacture of the spark plug.

In Examples 4 and 5, the flange 22 and the stepped portion 17 are in point contact with each other. Thus, it is assumed that the flange 22 and the stepped portion 17 adhere to each other with high adhesion, and the far-end sealant 61 is prevented from intruding in the step of manufacturing the spark plug 100. On the other hand, Examples 4 and 5 have a relatively high angle difference (θ1−θ2), and thus have a portion of the flange 22 that is in point contact with the stepped portion 17 in a shape with a nearly acute angle. Thus, the powder material of the far-end sealant 61 is assumed to have intruded between the flange 22 and the stepped portion 17 attributable to, for example, vibrations caused in a transportation step between the filling step of the far-end sealant 61 to the heat compression step.

TABLE 2

| | (D1-D2)/2 (mm) | Cracking of Insulator |
|---|---|---|
| Comparative Example 3 | 0.11 | C |
| Comparative Example 4 | 0.13 | C |
| Example 6 | 0.15 | A |
| Example 7 | 0.17 | A |

The results in Table 2 reveal the followings. In Examples 6 and 7 where a half of the value (D1−D2) is greater than or equal to 0.15 mm, no cracking of the insulator 10 was observed. On the other hand, in Comparative Examples 3 and 4 where a half of the value (D1-D2) is smaller than or equal to 0.13 mm, cracking of the insulator 110 was observed. These results are assumed to be caused due to an insufficient size of the gap G2 between the stepped portion 117 and the opposing surface S of the flange 122 since a half of the value (D1−D2) is smaller than or equal to 0.13 mm in Comparative Examples 3 and 4. Thus, it is assumed that, in Comparative Examples 3 and 4, the foreign object B is filled up in the gap G2, and the center electrode 120 thermally expands under high-temperature environments, and a stress is applied from the flange 122 of the center electrode 120 to the stepped portion 117 of the insulator 110. This is assumed to be a cause of cracking of the insulator 110.

C. Other Embodiments

The present invention is not limited to the above embodiments, and may be embodied in various forms within the range not departing from the gist thereof. For example, the technical features in the embodiments corresponding to the technical features in each form described in Summary of Invention may be changed or combined as appropriate to solve part or entirety of the above problem or to achieve part or entirety of the above effects. The technical features may be deleted as appropriate unless otherwise described as being essential herein.

REFERENCE SIGNS LIST

10 insulator
11 through-hole
14 large-diameter portion
15 locking portion
16 small-diameter portion
17 stepped portion
20 center electrode
leg
22 flange
23 head
25 core material
26 electrode member
30 metal shell
31 tool engagement portion
32 external-thread portion
seating portion
34 protrusion
35 crimping portion
36 compressed-deformed portion
37 front end surface
38 axial hole
40 ground electrode
42 electrode tip
50 metal terminal
61 far-end sealant (sealant)
62 resistor element
63 rear-end sealant
65 gasket
66, 67 ring member
69 talc
90 engine head
93 internal thread
95 combustion chamber
100 spark plug
110 insulator
117 stepped portion
120 center electrode
122 flange
AD axial-line direction
B foreign object
CA axial line
G1 gap
G2 gap
P plane
S opposing surface
X dimension
Y dimension

What is claimed is:

1. A spark plug, comprising:

a center electrode including a leg extending in an axial-line direction parallel to an axial line, and a flange that is continuous with a rear end side of the leg in the axial-line direction and protrudes radially outward beyond the leg;

an insulator having a through-hole extending in the axial-line direction, the insulator holding the center electrode in the through-hole; and a sealant filled in the through-hole to fix the flange and the insulator to each other, wherein the insulator includes a stepped portion in which the through-hole reduces a diameter toward a front end side in the axial-line direction, the stepped portion supporting the flange, and a small-diameter portion that is continuous with a front end side of the stepped portion and in which the diameter of the through-hole is smaller than in the stepped portion, wherein an angle $\theta 1$ formed by the stepped portion and a plane perpendicular to the axial line and an angle $\theta 2$ formed by the plane and an opposing surface of the flange opposing the stepped portion satisfy $\theta 1-\theta 2 \geq 6°$, and wherein, in a cross section including the axial line, a maximum diameter D1 of the flange and a diameter D2 of the through-hole at a rear end of the small-diameter portion in the axial-line direction satisfy 0.15 mm (D1−D2)/2.

2. The spark plug according to claim 1, wherein the angle $\theta 1$ satisfies $25° \leq \theta 1 \leq 35°$.

3. The spark plug according to claim 1, wherein the angle $\theta 1$ and the angle $\theta 2$ satisfy $\theta 1-\theta 2 \leq 20°$.

4. The spark plug according to claim 2, wherein the angle $\theta 1$ and the angle $\theta 2$ satisfy $\theta 1-\theta 2 \leq 20°$.

* * * * *